US005582014A

United States Patent [19]

Lyon et al.

[11] Patent Number: 5,582,014

[45] Date of Patent: Dec. 10, 1996

[54] HALON RECOVERY SYSTEM

[75] Inventors: Richard Lyon, Owasso; George O'Brien; Bob Hampton, both of Tulsa, all of Okla.

[73] Assignee: American Airlines, Inc., DFW Airport, Tex.

[21] Appl. No.: 166,637

[22] Filed: Dec. 15, 1993

[51] Int. Cl.[6] ..... F25J 3/00

[52] U.S. Cl. ..... 62/606; 62/48.2; 62/292; 62/475

[58] Field of Search ..... 62/11, 18, 28, 62/37, 48.2, 292, 77, 474, 475

[56] References Cited

U.S. PATENT DOCUMENTS

| | | |
|---|---|---|
| 2,315,263 | 3/1943 | Lindsay . |
| 4,261,178 | 4/1981 | Cain . |
| 4,761,961 | 8/1988 | Marx . |
| 4,942,741 | 7/1990 | Hancock et al. . |
| 5,097,667 | 3/1992 | Gramkow . |
| 5,101,637 | 4/1992 | Daily . |
| 5,150,577 | 9/1992 | Mitchell et al. . |
| 5,183,116 | 2/1993 | Fleming . |
| 5,189,881 | 3/1993 | Miles . |
| 5,263,326 | 11/1993 | Block et al. ..... 26/18 |

*Primary Examiner*—John M. Sollecito
*Attorney, Agent, or Firm*—Warren & Perez

[57] ABSTRACT

The present invention relates to a system for recycling a halocarbon composition which generally removes a halocarbon composition from a first source to purify the halocarbon composition and injects the halocarbon composition to a second source. The present invention is particularly useful for recovering and recharging of a commonly used halocarbon composition, Halon 1301. The invention comprises a first line having a first and second end where the first end of the first line is connected to the first source. The first source has the halocarbon composition contained therein. A vapor recovery unit connects to the second end of the first line for permitting the halocarbon composition to be transported from the first source to the vapor recovery unit for compression. A second line connects the vapor recovery unit to a recovery bottle. The recovery bottle is cooled by a cooling system integrally connected thereto for separating the nitrogen from the halocarbon composition. Once the halocarbon gas has been purified, a return line which connects the recovery bottle to permit the purified halocarbon composition to return to a second source for later usage.

11 Claims, 3 Drawing Sheets

HALON RECOVERY SYSTEM

TECHNICAL FIELD OF THE INVENTION

The invention relates to a system and method for recycling a halocarbon composition and in particular to a system and method for recycling and recharging a halocarbon composition, such as Halon 1301.

BACKGROUND OF INVENTION

As environmental issues become increasingly more important, the economic burden on corporations imposed by regulatory agencies becomes a paramount consideration. One such consideration is the ozone depletion which has been shown to be detrimentally affected by chemicals allowed to vent into the atmosphere. Such chemicals of most concern are man-made compounds known as chloroflourocarbons (CFC's) and other halogen combining compounds. Chloroflourocarbons are useful for refrigeration and air conditioning systems and are widely used as aerosol propellants. Another useful halogen containing compound is Halon. Halon is widely used in fire extinguishing systems. For example, Halon 1301 is used in fire extinguishing systems for commercial and military aircraft and is an essential ingredient in aircraft flight safety.

Frequent handling of Halon 1301 is mandatory since the FAA requires hydrostatic testing of each bottle of Halon 1301 used. In order to perform these tests the bottles must be emptied which creates the risk that the Halon can be lost to the atmosphere. Prior to the environmental concerns, Halon was simply discharged into the air to empty a bottle. Such conduct is no longer acceptable and emission of Halon to the atmosphere carries extreme regulatory penalties.

Since Halon is detrimental to the earth's ozone layer, government regulations have been passed to limit and eventually eliminate the production of Halon. In fact, Halon will no longer be produced after 1993. Severe penalties will be imposed for any release of Halon into the atmosphere. Furthermore, in January 1994 the tax on one pound of Halon will escalate from $0.25 per pound to $26.50 per pound.

Despite the need for a system to efficiently recycle halocarbon compositions, to date there have been no systems that can recycle halocarbon compositions at a high percent while maintaining a low operating cost. In addition, there is not a system for purifying the halocarbon composition integrally operating with a system for recharging a collection vessel immediately after purification.

SUMMARY OF INVENTION

The present invention discloses a system for removing nitrogen gas from a halocarbon composition source and recycling the halocarbon composition source for reuse in a collection vessel. The system comprises a gas compressor, such as a vapor recovery unit, which receives the halocarbon composition source from an inlet means. The gas compressor pressurizes the halocarbon composition to a predetermined pressure of approximately 210 pounds per square inch gauge (psig). Once the halocarbon composition has been pressurized, it flows to a recovery bottle for receiving the halocarbon composition. The recovery bottle is cooled by a cooling means whereby the chilling causes the nitrogen gas previously contained in the halocarbon composition source to separate from the halocarbon composition. The cooling means maintains the temperature of the halocarbon composition gas at approximately −50 degrees F. Once the nitrogen gas has separated from the halocarbon composition a venting means is actuated which permits the nitrogen gas to vent from the recovery bottle.

In order to reuse the purified halocarbon gas in the bottle, the system further comprises a recharging system for collecting the halocarbon composition gas in a collection vessel which comprises a return means for connecting the collection vessel with the recovery bottle. After the purified halocarbon gas has been transferred to the collection vessel, a nitrogen source connected to the collection vessel is actuated for pressurizing the collection vessel to a predetermined pressure.

In operation, a method for recovering and purifying the halocarbon gas comprises the steps of placing a vacuum on the halocarbon composition source and directing the halocarbon composition from its source to a vapor recovery unit. Once at the vapor recovery unit, the gas is pressurized and sent to a recovery bottle which has been cooled to a predetermined temperature for separating the nitrogen gas from the halocarbon composition. Once the gases have been separated, the step of venting the recovery bottle permits the nitrogen to escape from the system leaving a purified halocarbon composition gas. Once purified, the halocarbon composition gas is sent to a collection vessel and stored for later use.

BRIEF DESCRIPTION OF THE DRAWINGS

The present invention can be more readily understood by reference to the brief description of the Drawings set forth below.

DETAILED DESCRIPTION OF THE INVENTION

Figure 1:
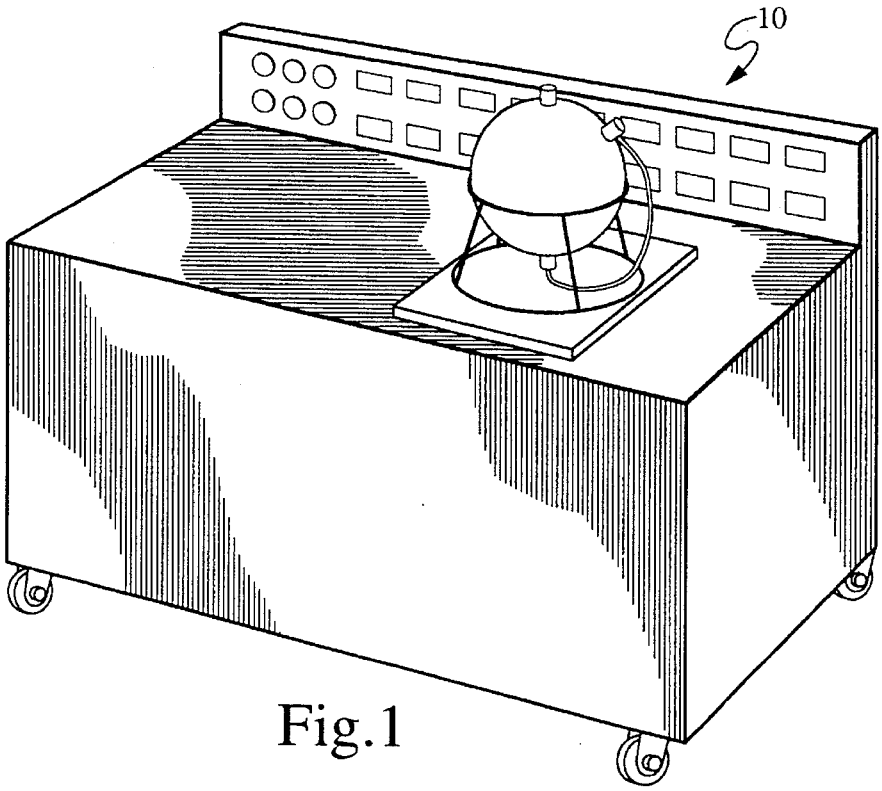
FIG. 1 is a perspective view of the halocarbon recovery system.

The present invention generally relates to a method for recycling a halocarbon composition. Specifically, the present invention discloses a method for recycling a Halon 1301 composition commonly used for extinguishing fire in an aircraft. Referring to FIG. 1, a halocarbon recovery system generally designated 10 can be seen. System 10 comprises other components which are disclosed below.

Figure 2:
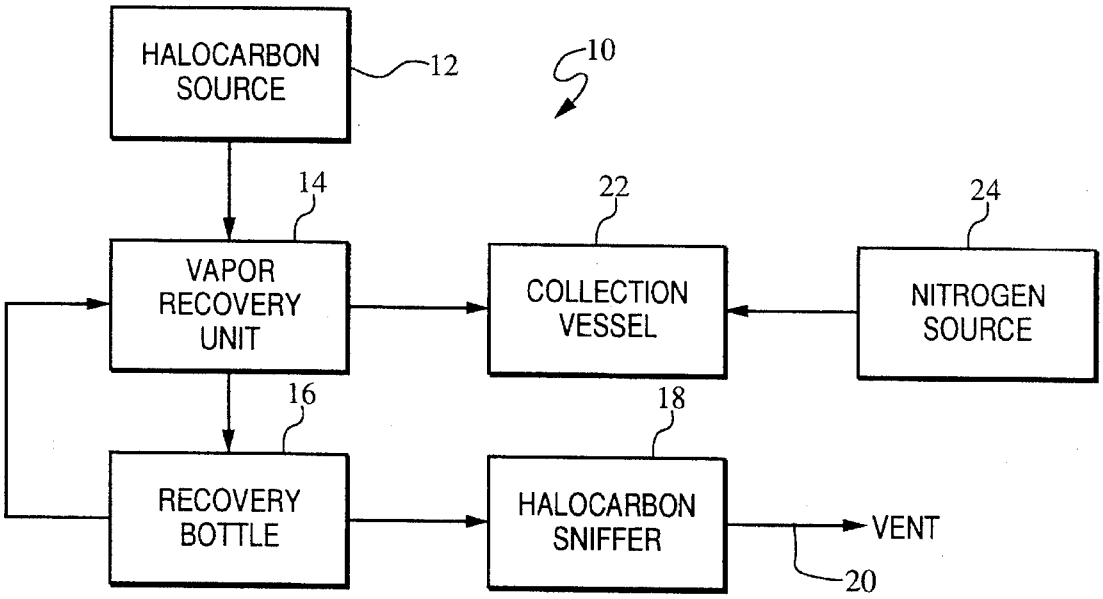
FIG. 2 is a block diagram of the halocarbon recovery system.

Referring to FIG. 2, the present invention can be seen in a block diagram. System 10 generally comprises a halocarbon source 12 which is in fluid connection with a vapor recovery unit 14. Vapor recovery unit 14 pressurizes gas to flow from vapor recovery unit 14 to a recovery bottle 16. Recovery bottle 16 has a cooling system (not shown) integrally connected thereto for chilling the halocarbon composition to a sufficient level to permit the nitrogen gas present to separate from the halocarbon composition. Once separated, nitrogen is vented from recovery bottle 16 to a halocarbon vent 20. Halocarbon vent 20 has a halocarbon sniffer 18 to allow operator to sniff inside recovered bottles and joints on the machine for detecting the presence of any halocarbon composition.

Once the halocarbon composition has been purified in recovery bottle 16, the halocarbon composition is generally pressurized through vapor recovery unit 14. Once compressed, the purified halocarbon composition flows to a collection vessel 22. In order to obtain the optimum pressure in collection vessel 22, a nitrogen source 24 is connected to collection vessel 22 for pressurizing collection vessel 22 to the predetermined pressure.

Figure 3:
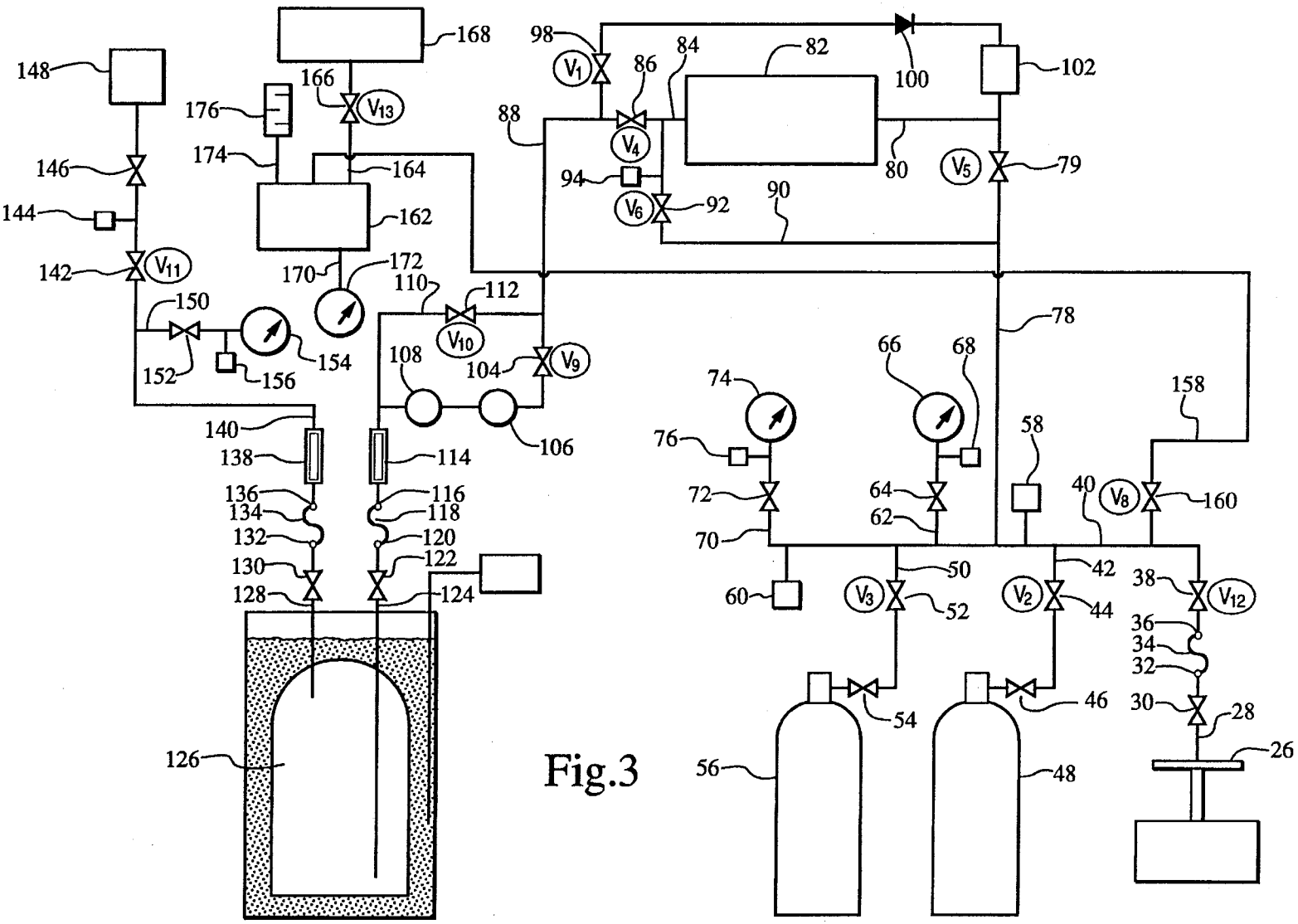
FIG. 3 is a detailed schematic diagram of the halocarbon recovery system.

The operation of the halocarbon recovery system can be more readily understood by reference to FIG. 3. System 10 comprises a scale 26 which weighs the halocarbon composition source (not shown). Connected to the halocarbon composition (not shown) is an inlet line 28. While inlet line 28 may be made of many compositions, in one embodiment inlet line 28 is generally a rigid 0.5 inch 304 stainless steel piece of tubing which is connected to a valve 30. Valve 30 can be one of several types, but in one embodiment valve 30 is a manual valve. Valve 30 is connected to a hose 34 by a coupling 32. Hose 34 is capable of withstanding pressures in excess of the vapor pressure of the halocarbon composition gas used in system 10. Hose 34 is connected to a coupling 36 and subsequently in fluid connection with a valve 38. Valve 38 is generally a Marwin one-half inch ball valve, VA126-RRRS W/AT2-SR spring return actuator type. Valve 38 is connected to a header 40.

Header 40 permits fluid communication between the halocarbon composition source (not shown), a nitrogen source 48 and a collection vessel 56. A nitrogen line 42 is connected to header 40. In addition, line 42 is connected to a valve 44. In one embodiment, valve 44 is a Marwin one-half inch ball valve. Valve 44 is in fluid communication with a valve 46 which is the valve to nitrogen source 48. A halocarbon line 50 is connected to header 40 and is in fluid communication with a valve 52. In one embodiment, valve 52 is a Marwin one-half inch ball valve. Valve 52 is connected to a valve 54 which is connected to collection vessel 56 which is used to recapture the halocarbon composition (not shown) after it has been recycled and purified. Also connected to header 40 is a temperature gauge 60. Temperature gauge 60 is used to monitor the temperature of header 40 and the fluid contained therein. A pressure line 62 is connected to header 40. A valve 64 is coupled to line 62 and is in communication with the pressure valve 66. A test port 68 is also connected to line 62. Pressure gauge 66 monitors the pressure on header 40. A second pressure line 70 is connected to header line 40. Coupled to line 70 is a valve 72 and a pressure gauge 74. A test port 76 is also connected to pressure line 70. Gauges 66 and 74 can be one of several type of gauges, however, in one embodiment are Sensotec 0–1000 psig digital LED gauge with remote sensors and pressure transducer model 7/761-29-02, model GM.

Valves 38, 40 and 52 are generally designated Valve 12 ("V12"), Valve 2 ("V2"), and Valve 3 ("V3") when referring to the control system for system 10. These designations will be more readily understood after subsequent disclosure.

A vapor recovery line 78 is connected to header 40 and to a valve 79. In one embodiment, valve 79 is a Marwin one-half inch ball valve with a spring return actuator of the type detailed above. Valve 79 is more commonly designated and referred to as Valve 5 ("V5") when referring to the control system. Valve 79 is connected to a suction line 80. Suction line 80 connects valve 79 to a vapor recovery unit 82. While vapor recovery unit 82 can be of several types, in one embodiment, vapor recovery unit 82 is a Frick BLU-COLD model VRU-10003 Halon 1301 recovery unit. Vapor recovery unit 82 is connected to discharge line 84. Also connected to discharge line 84 is a valve 86. In one embodiment, valve 86 is a Marwin one-half inch ball valve with a spring return actuator of the type detailed above. When referring to the control system, valve 86 is more commonly referred to as Valve 4 ("V4"). Connected to valve 86 is a recovery bottle line 88.

Also connected to discharge line 84 is a bypass line 90. Bypass line 90 has a valve 92 connected thereto. In one embodiment, valve 92 is a Marwin one-half inch ball valve with a spring return actuator. Valve 92 is more commonly designated Valve 6 ("V6") when referring to the control system. Connected to line 90 is a temperature gauge 94 for detecting the temperature in line 90. A return line 96 is connected to recovery bottle line 88. A valve 98 is connected to line 96. In one embodiment, valve 98 is a Marwin one-half inch ball valve with spring return actuator and is more commonly designated as Valve 7 ("V7") in its control system. Also connected to line 96 is a check valve 100. Check valve 100 can be one of several types which will only permit one-way flow through line 96. Connected to check valve 100 is a dryer 102. Dryer 102 is contained in the system for removing any fluids which may accumulate in the gas. One of several types of dryers may be used, but in one embodiment, dryer 102 is an Alco liquid line filter dryer EK3C4S.

Connected to recovery bottle line 88 is a valve 104. In one embodiment, valve 104 is a Marwin one-half inch ball valve with a spring return actuator. Valve 104 is more commonly referred to as Valve 9 ("V9") in control system. In an alternative embodiment, valve 104 can be a Joule-Thomson ("JT") valve which would controllably reduce the pressure from the vapor recovery unit 78 to correspondingly lower the temperature of the processed gas and thus reducing subsequent refrigeration or cooling requirements. Connected to valve 104 is a dryer/filter 106. In one embodiment, dryer/filter 106 is a Sparks R22-0001-RF-005 Coalescing Filter Vessel with 3212176N Element. Connected to dryer/filter 106 is a dryer 108 which can be an Alco liquid line filter dryer of the type EK3C4S. Also connected to line 88 is a bypass line 110. Connected to bypass line 110 is a valve 112, which in one embodiment is a Marwin ball valve with a spring return actuator. Valve 112 is more commonly referred to as Valve 10 ("V10") when referring to the control system. Connected between the dryer is a sight glass 114. Sight glass 114 can be one of several types, but in one embodiment is a Brooks series 8000A one-half inch NPT 600 psig rated sight glass. Connected subsequent to the sight glass is a coupling 116. Connected to coupling 116 is a hose 118 which is connected at the other end to a coupling 120. Connected next to coupling 120 is a valve 122 which is a manual valve similar to those used throughout a first embodiment. Connected to valve 122 is a recovery bottle inlet line 124. The inlet line 124 is inserted into the interior of a recovery bottle 126. Recovery bottle can be one of several types but in one embodiment is a 92 cubic foot aluminum standard scuba tank. The discharge of bottle 126 is a recovery bottle outlet line 128. Line 128 is connected to valve 130. Valve 130 is connected to a coupling 132 which is connected to hose 134 and a second coupling 136. Similar to the inlet, there is a sight glass 138 connected to coupling 136. Sight glass 138 is used to monitor the flow of any fluid through a vent line 140.

Line 140 is used to transport any nitrogen contained in bottle 126 which flows through line 140 to valve 142. Valve 142, like the other valves, can be one of several types, but in its first embodiment is a Marwin one-half inch ball valve with a spring return actuator. Valve 142 is more commonly referred to as Valve 11 ("V11"). Connected to vent line 140 is a pressure line 150 which has a valve 152 and a gauge 154 connected thereto. Also a test port 156 is connected to line 150. Pressure valve 154 is used to detect the pressure of the vent line 140. Connected to the outlet side of valve 142 is the vent to atmosphere 148. Between valve 142 and vent 148 is a valve 146 and a sniffer 144. Sniffer 144 can be placed in line to detect the presence of any halocarbon composition. Sniffer 144 is used to detect the presence of the halocarbon composition and to determine the efficacy of the system. Sniffer 144, in one embodiment, is a TIF Instruments, HLD440 Halogen Leak Detector. In operation, sniffer 144 operates independently of machine to a control panel (not shown) in effect to control any excess amount of halocarbon leaving the system.

System 10 is equipped with a vacuum line 158 connected to header 40 and a vacuum pump 162. A valve 160 is connected to line 158. Valve 160 can be one of several types but in its first embodiment is a Marwin one-half inch ball valve with spring return actuator. Valve 160 is a more commonly referred to as Valve 8 ("V8") in its control system. Vacuum pump 162 has an air line 164 connected thereto. Line 164 has a valve 166 connected thereto. Valve 166 is a control valve which in its first embodiment is a Marwin one-half inch ball valve with spring return actuator. Valve 166 is more commonly referred to as Valve 13 ("V13") in its control panel. Connected to valve 166 is an air supply 168. Also connected to vacuum pump 162 is a pressure line 170. Line 170 is connected to a pressure valve 172 for determining the pressure of vacuum pump 162. Pressure gauge 172 can be one of several types, but in its first embodiment is a Sensotec 0–12 psiu Digital LED gauge with remote sensor, pressure transducer model V/1945-0502, model GM. Also connected to vacuum pump 162 is a muffler line 174. Muffler line 174 is also connected to a muffler 176. The operation of system 10 can be more readily understood by reference to the electrical ladder block diagram set forth below.

Figure 4:
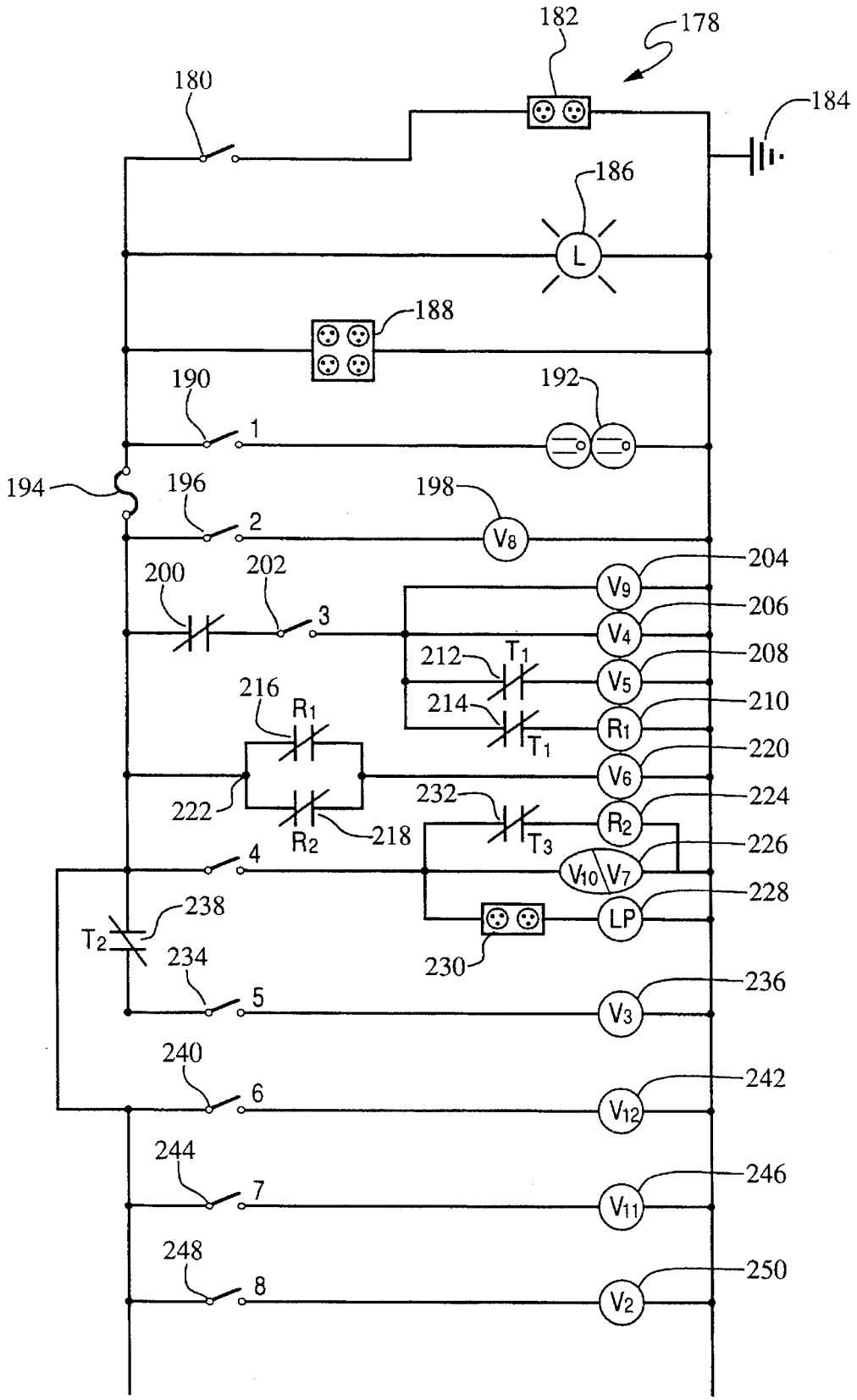
FIG. 4 is an electrical ladder block diagram of controls in the halocarbon recovery system.

Referring now to FIG. 4, the control system for the present invention can be seen as an electrical ladder block diagram. The electrical ladder diagram illustrates the control panel for the present invention. This embodiment can be one of several different configurations, however, FIG. 4 is exemplary of the invention. An electrical system 178 is set forth which shows a master valve 180 electrically connected to a plug for the scales 182. Plugs 182 are connected to a ground 184 to prevent any damage to the electrical system. Also contained in the electrical system 178 is a light 186 to illustrate whether the system is on or off. Master switch 180 also actuates a gauge plug 188. A switch 190 which is more commonly referred to as Switch 1 ("SW1") controls the operation of a vapor recovery switch 192. As can be appreciated, switch 192 operates the vapor recovery unit illustrated in FIG. 3. A fuse 194 connects switch 190 to a switch 196. Switch 196 is more commonly referred to as Switch 2 ("SW2"). Switch 2 controls controller 198 which is a controller for the valve designated V8 in the preceding figure. A regulator 200 is connected to a switch 202. Switch 202 is more commonly referred to as Switch 3 ("SW3"). Switch 3 controls four separate functions. First, it controls the function of a valve designated 204, which is more commonly referred to as V9. Second, Switch 3 controls a controller 206 which operates a valve designated V4. Third, Switch 3 controls a controller 208 which corresponds to the operation of a valve V5. Four, switch 3 controls a switch regulator 1. In addition, regulator number 1 is monitored by a temperature gauge 214 and valve V5 is monitored by a temperature gauge 212.

A first and second regulator designated 216 and 218, respectively, control a controller switch 220 which corresponds to valve V6. A fourth switch designated 222 is more commonly to as Switch 4 ("SW4"). Switch 4 controls three different functions. First, Switch 4 controls regulator 2 which is designated as controller 224. Second, Switch 4 controls the operation of valve V10 and V7 which is noted as controller 226. Third, Switch 4 controls the low pressure designation or switch 228. Switch 228 is connected to a plug 230. Regulator 224 is connected to a temperature controller 232.

A switch 234 which is more commonly referred to as Switch 5 ("SW5") is electrically connected to switch 222 through a temperature indicator 238. Switch 5, designated 234, controls the operation of a controller 236 which corresponds to the operation of the valve designated V3.

A switch 240 which is more commonly referred to as Switch 6 ("SW6") controls the controller 242 which corresponds to the operation of the valve designated V12. A switch 244, which is more commonly designated as Switch 7 ("SW7"), controls controller 246 which correspondingly operates valve V11. A switch 248, which is more commonly designated as Switch 8 ("SW8"), controls a switch 250 which correspondingly operates valve V2. The operation of system 10 can be more readily understood by reference to the operation system set forth below.

OPERATION

The system can be more readily understood by simultaneously referring to FIGS. 3 and 4. In operation the system can be separated out into two distinct and separate steps. First, the step of recovering and purifying any Halon. Second, the step of charging the Halon fire bottle or recovery bottle.

Specifically, the present invention discloses a system for removing nitrogen gas from a halocarbon composition source and recycling the halocarbon composition source for reuse in a collection vessel. The system uses the gas compressor, such as a vapor recovery unit, which receives the halocarbon composition source from the inlet means. The gas compressor pressurizes the halocarbon composition to a predetermine pressure of approximately 210 pounds per square inch gauge (psig). The operating pressure can vary considerably. Once the halocarbon composition has been pressurized, it flows to the recovery bottle for receiving the halocarbon composition. The recovery bottle is cooled by the cooling means whereby the chilling causes the nitrogen gas previously contained in the halocarbon composition source to separate from the halocarbon composition. The cooling means maintains the temperature of the halocarbon composition gas at approximately –50 degrees F. The operating temperature can vary and is dependent upon the extent the nitrogen separates from the halocarbon. Once the nitrogen gas has separated from the halocarbon composition the venting means is actuated which permits the nitrogen gas to vent from the recovery bottle.

In order to reuse the purified halocarbon gas in the bottle, the system further comprises the recharging system for collecting the halocarbon composition gas in a collection vessel which comprises the return means for connecting the collection vessel with the recovery bottle. After the purified halocarbon gas has been transferred to the collection vessel, the nitrogen source connected to the collection vessel is actuated for pressurizing the collection vessel to a predetermined pressure. This pressure is controlled by regulations and other predetermined parameters.

In operation, a method for recovering and purifying the halocarbon gas comprises the steps of placing a vacuum on the halocarbon composition source and directing the halocarbon composition from its source to the vapor recovery unit. Once at the vapor recovery unit, the gas is pressurized and sent to a recovery bottle which has been cooled to a predetermined temperature for separating the nitrogen gas from the halocarbon composition. Once the gases have been separated, the step of venting the recovery bottle permits the nitrogen to escape from the system leaving a purified halocarbon composition gas. Once purified, the halocarbon composition gas is sent to a collection vessel and stored for later use.

Specifically, in operation, a Halon bottle, which needs to be recharged or repaired, is brought to the scales (not shown) and connected to system 10. In operation, the master switch is turned on. The second step is the step of turning on switches 1, 3, 6. The pressure of the fire bottle is observed. If the pressure is over 285 psi then switch 7 is turned on until the pressure reads between 210–215 psi. Then once that pressure has been obtained switch 7 is closed. If the pressure decreases below 50 psi, frost may appear on the lower part of the system. If this is done, then heat is applied with a heat gun to the lower part to increase pressure of the system. When the Halon recovery pump cycles off and stabilizes at 3–5 psiu then the bottle is empty, thus signifying the bottle brought to the system has completely been void of any Halon or any debris such as water vapor. Once this has been accomplished, then the switches 1, 3, 6 are turned off. In order to operate the vapor recovery unit, switches 1, 4, 5 are turned on; therefore causing pressure to increase through the system to charge up the bottle. In order to vent the nitrogen to the atmosphere the switch 7 is used to control pressure as previously discussed. When charging the bottle, or a second bottle, up again then the steps in essence are reversed and the gas flows from the bottle to a new vessel. This is done by making sure that the master switch is on and turning switches 2 and 6 off. This transfers Halon to the fire bottle by turning switches 5 and 6 on therefore in order to maintain such pressure a nitrogen source is brought to the system by turning switches 6 and 8 on, therefore pressurizing the fire bottle to desired pressure.

EXAMPLE

On Mar. 3, 1993, a cylinder containing Halon 1301 identified as R009 was processed through the system as disclosed above. The composition in the cylinder was passed through the system once. The resulting composition was analyzed at the National Refrigerants, Inc. Analytical Laboratory in Bigdeton, N.J. The analysis of the sample and the corresponding military specification (MIL-M-12218C) are set forth below:

| Analysis | Sample | Military Spec |
|---|---|---|
| Purity (Mole %) | 99.95 | 99.6 min. |
| Other Halocarbons (Mole %) | 0.05 | 0.4 max. |
| Acidity (ppm wt.) | <0.08 | 3.0 max. |
| Halogen Ion | Pass | Pass Test |
| Water (wt. %) | 0.0004 | 0.001 max. |
| NAG (Vol %) | O2 = 0.07<br>N2 = 2.00 | 1.5 max. |
| High Boiling Imp's (g/100 ml) | <0.01 | 0.05 max. |
| Suspended Matter | None visible | None visible |

The present invention discloses a method for removing a halon composition source from a tank and moving it to a chilled recovery bottle. Once its in the bottle then nitrogen is vented out of the bottle to leave a purified halocarbon composition. Once there has been a purified halocarbon composition then the halocarbon can return to a vessel for subsequent use as a fire extinguisher. The halocarbon composition can pass through the vapor recovery unit in order to pressurize the gas to insure that all the gas is within the halocarbon collection vessel. In order to maintain the desired pressure a nitrogen source is connected to the collection vessel to pressurize the vessel to a predetermined pressure. The present invention incorporates two distinct ideas in order to maintain efficiency, economy and to reduce the environmental impact due to the extreme conditions that halon compositions have on our atmosphere by reducing ozone.

The present invention may be carried out in other specific ways other than those set forth herein without parting from the spirit and essential characteristics and scope of the present invention. The present embodiments set forth above are to be considered in all respects as illustrative and non-restrictive and all changes coming within the equivalency range of the appended claims are intended to be embraced within this invention.

What is claimed is:

1. A halocarbon recovery and recharging system for removing a halocarbon composition from first source and recovering the halocarbon composition in a second source, comprising:

a first line having a first end and a second end, said first end of said first line connected to the first source;

a vapor recovery unit connected to said second end of said first line for compressing the halocarbon composition from the first source;

a second line having a first end and a second end, said first end connected to said vapor recovery unit;

a recovery bottle connected to said second end of said second line to receive and to store the halocarbon composition from said vapor recovery unit;

a cooling system integrally connected to said recovery bottle for cooling the halocarbon composition;

a return line for permitting the halocarbon composition to flow from said recovery bottle to the second source;

a vent line connected to said recovery bottle permitting thinning of said recovery bottle; and a halocarbon detection system connected to said vent line for detecting the presence of the halocarbon composition.

2. The system as recited in claim 1, further comprising a vacuum pump system connected to said first line for sucking the halocarbon composition from the first source.

3. The system as recited in claim 1, further comprising a nitrogen source connected to the second source for pressurizing the second source.

4. The system as recited in claim 1, further comprising a dryer connected to said second line for reducing the formation of hydrates.

5. The system as recited in claim 1, further comprising a filter connected to said second line.

6. A system for removing nitrogen gas from a halocarbon composition source comprising:

a gas compressor;

inlet means for connecting the halocarbon composition source to said gas compressor for pressurizing the halocarbon composition;

a bottle for receiving the halocarbon composition from said gas compressor;

cooling means for cooling said bottle and halocarbon composition contained therein to separate nitrogen gas from the halocarbon composition;

venting means for venting the separated nitrogen gas from said bottle; and a vacuum system connected to the halocarbon composition source for removing halocarbon composition.

7. The system as recited in claim 6, further comprising a pressure controller for selectively operating said vacuum system.

8. The system as recited in claim 6, wherein said gas compressor has a discharge pressure of approximately 200 pounds per square inch gauge.

9. The system as recited in claim 6, wherein said cooling means maintains the temperature of the halocarbon composition at approximately –50.0 degrees F.

10. The system as recited in claim 6, further comprising a recharging system for collecting the halocarbon composition in a recovery tank, which comprises:

return means for connecting said bottle with said recovery tank; and a nitrogen source connected to said recovery tank for pressurizing said recovery tank.

11. The system as recited in claim 10, further comprising a pressure gauge for monitoring pressure in said recovery tank.

* * * * *